United States Patent [19]

Yamakoshi

[11] Patent Number: 4,994,839

[45] Date of Patent: Feb. 19, 1991

[54] DEVELOPING DEVICE USING PLURALITY OF TANKS

[75] Inventor: Yukiyoshi Yamakoshi, Osaka, Japan

[73] Assignee: Minolta Camera Kabushiki Kaisha, Osaka, Japan

[21] Appl. No.: 358,825

[22] Filed: May 30, 1989

[30] Foreign Application Priority Data

May 30, 1988 [JP] Japan ..... 63-132221

[51] Int. Cl.[5] ..... G03D 3/08

[52] U.S. Cl. ..... 354/322; 354/321

[58] Field of Search ..... 354/316, 320, 321, 322, 354/331, 299; 355/27

[56] References Cited

U.S. PATENT DOCUMENTS 2,551,892 5/1951 Mitchell ..... 354/299
3,079,852 3/1963 Little et al. ..... 354/322
4,705,377 11/1987 Kobayaslri et al. ..... 354/322

FOREIGN PATENT DOCUMENTS 63-98665 4/1989 Japan .

*Primary Examiner*—A. A. Mathews
*Attorney, Agent, or Firm*—Willian Brinks Olds Hofer Gilson & Lione

[57] ABSTRACT

This invention is to provide a developing device for developing images by means of a photographic process wherein a photographic film is sequentially transported through a developing fluid, a bleach fixing fluid and a stabilizing fluid, and the device comprises developing tank containing the developing fluid, a bleach fixing tank containing the bleach fixing and a stabilizing tank containing the stabilizing fluid, said bleach fixing tank is independently movable in the vertical direction so as to prevent contamination of the developing and stabilizing fluids by the bleach fixing fluid.

9 Claims, 6 Drawing Sheets

DEVELOPING DEVICE USING PLURALITY OF TANKS

FIELD OF THE INVENTION

The present invention relates to a developing a device using a plurality of tanks and which develops an image by sequentially transporting a photographic film or the like. More particularly the present invention relates to an apparatus for forming images by means of a photographic process wherein photographic film, light-sensitive material such as photographic paper or the like having silver halide emulsion layers containing silver halide color photographic light-sensitive material is sequentially transported to a developing tank, bleach-fixing tank, and stabilizing tank.

BACKGROUND OF THE INVENTION

The demand for color copies has increased in recent years and color copiers using electrophotographic processes have met this demand. Needs have not been adequately fulfilled, however, from the perspective of image quality.

To meet the need for better image quality, color copies using silver halide light-sensitive material has been proposed. Although equipment which uses silver halide light-sensitive material has the disadvantage, among others, of not being able to use regular paper, it is extremely desirable in view of the better image quality which is obtainable.

An apparatus for forming images through a photographic process using silver halide light-sensitive material has been devised, wherein, as shown in FIG. 1, a developing tank 3 with developing fluid 3*a* provided therein, bleach-fixing tank 4 with bleach-fixing fluid 4*a* provided therein, and stabilizing tank 5 with stabilizing fluid 5*a* provided therein are integrated in a single unit formed of plastic or like material, or a developing tank, bleach-fixing tank, and stabilizing tank are integratedly bonded together as a single unit, so as to transport the aforesaid light-sensitive material 1 sequentially through developing tank 3, bleach-fixing tank 4 and stabilizing tank 5 by means of transport rollers 6 and crossover guides 7 provided over the partitions separating each tank 3, 4 and 5, thereby accomplishing the developing process.

In the apparatus for forming images having a developing unit 2, when the aforesaid light-sensitive material 1 is transported in the previously described sequence, the developing fluid 3*a*, bleach-fixing fluid 4*a* and stabilizing fluid 5*a* fill the corresponding developing tank 3, bleach-fixing tank 4 and stabilizing tank 5 so as to be in proximity of the top edge thereof, as shown in FIG. 1, and thereby to shorten as much as possible the length of time during which said light-sensitive material 1 comes into contact with the air, and reduce the size of the device itself so as to accomplish the developing process with greater efficiency.

However, when fluids 3*a*, 4*a* and 5*a* completely fill the respective tanks 3, 4 and 5, said fluids may overflow into the adjacent tanks when the developing unit 2 is moved to remove jammed light-sensitive material 1 or for routine spot maintenance, inspection or cleaning, thereby mixing with the fluid originally contained therein.

Although the problem of developing fluid 3*a* or stabilizing fluid 5*a* overflowing into bleach-fixing tank 4 and mixing with the indigenous bleach-fixing fluid 4*a* contained therein is not of great concern, should the bleach-fixing fluid 4*a* overflow into the developing tank 3 and contaminate developing fluid 3*a*, the performance qualities of said developing fluid 3*a* will be markedly reduced, thereby preventing adequate development and necessitating the replacement of said developing fluid 3*a*.

SUMMARY OF THE INVENTION

The present invention resolves the aforesaid disadvantages of the developing apparatus.

That is, an object of the present invention is to provide a developing device which does not allow contamination of the developing fluid through mixing with bleach-fixing fluid that overflows into the developing tank when the developing unit is moved for routine maintenance or to clear paper jams or the like.

In the developing unit of the present invention, which provides a developing tank, bleach-fixing tank and stabilizing tank, said bleach-fixing tank is independently movable in the vertical direction.

In the thus constructed developing unit of the present invention, the bleach-fixing tank filled with bleach-fixing fluid is lowered vertically when the developing unit is moved for routine maintenance or clearing of paper jams or the like, so that the surface of the bleach-fixing fluid is below the fluid levels of the developing and stabilizing fluids which fill the developing and stabilizing tanks respectively, thereby preventing overflow of bleach-fixing fluid from the bleach-fixing tank into the developing tank and contamination of the developing fluid contained therein.

BRIEF DESCRIPTION OF THE DRAWINGS

These and other objects and features of the present invention will become apparent from the following description of the preferred embodiments thereof taken in conjunction with the accompanying drawings, in which:

FIG. 9 shows a brief elevation view of the same apparatus.

FIG. 10 shows a brief cross section view of the same apparatus.

FIG. 11 shows a brief perspective view of the same apparatus.

FIGS. 12 through 14 are fragmentary views showing the lock mechanism for locking the frame of the unit in the same apparatus.

In the following description, like parts are designated by like reference numbers throughout the several drawings.

DETAILED DESCRIPTION OF THE PREFERRED EMBODIMENTS

Details of the embodiments of the present invention are described hereinafter with reference to the accompanying drawings.

Figure 1:
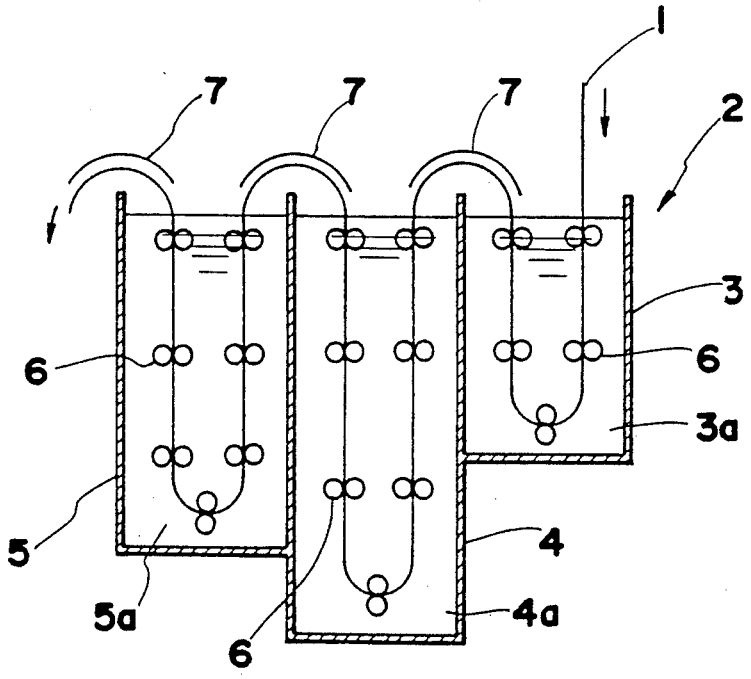
FIG. 1 Prior Art
FIG. 1 is a brief cross section view showing a developing unit related to a conventional apparatus for forming images.
Figure 2:
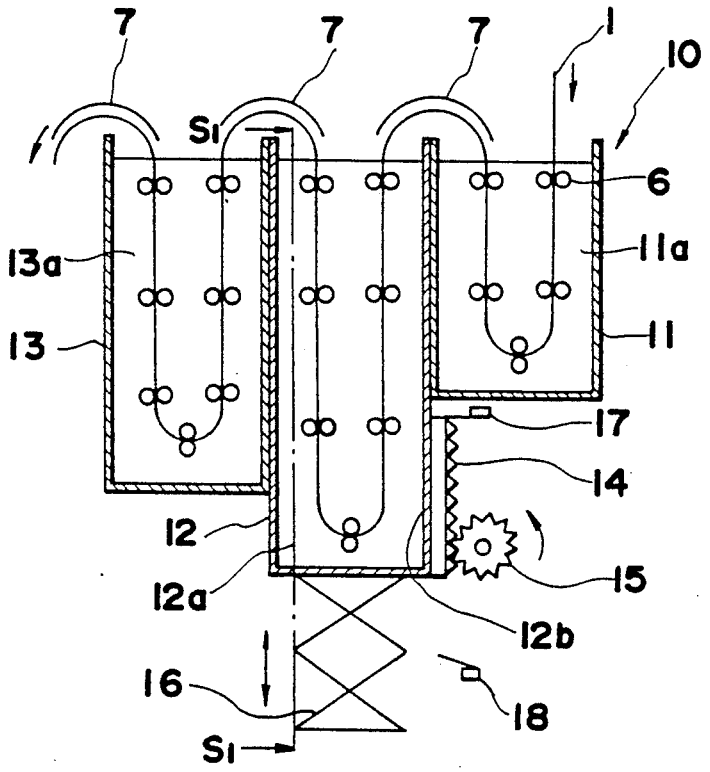
FIGS. 2 and 3 are brief cross section views showing a developing unit related to an embodiment of the present invention wherein the bleach-fixing tank is shown in the upward position state and downward position state.
Figure 4:
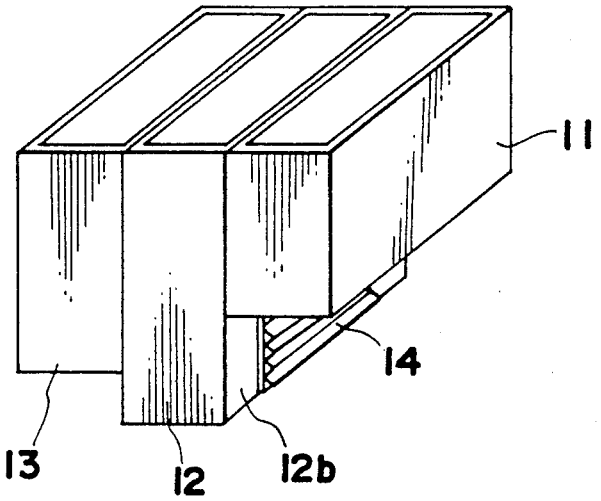
FIG. 4 is a perspective view showing each tank of the developing unit of the embodiment of FIGS. 2 and 3.

In the developing unit 10 of the present embodiments, in order to develop the exposed light-sensitive material 1, a developing tank 11 filled with developing fluid 11*a*, bleach-fixing tank 12 filled with bleach-fixing fluid 12*a* and stabilizing tank 13 filled with stabilizing fluid 13*a* are arranged in the aforesaid order, said tanks 11, 12 and 13 being independently constructed with the centrally disposed bleach-fixing tank being vertically movable, as shown in FIGS. 2 and 4.

In the present embodiment, the bleach-fixing tank 12 is provided so as to be vertically movable, the side wall 12*b* of said bleach-fixing tank 12 being provided with a rack 14 extending vertically with a pinion 15 arranged opposite so as to correspond with said rack 14, said pinion 15 being rotatable by a motor (not shown in the drawing) so as to raise and lower said bleach-fixing tank 12.

Further, in producing the vertical movement of the bleach-fixing tank 12, a support spring 16 is provided at the bottom of said bleach-fixing tank 12 so as to apply a supportive raising force to the bottom of tank 12 by means of said spring 16 in order to reduce the negative load on the motor when the pinion is rotated to raise the bleach-fixing tank 12.

In this developing unit 10, light-sensitive material 1 is sequentially guided through developing tank 11, bleach-fixing tank 12 and stabilizing tank 13 by means of transport rollers 6, the aforesaid pinion 15 is rotated by means of a motor in the direction which raises the bleach-fixing tank 12, as shown in FIG. 2, said bleach-fixing tank 12 thereby being raised until the top edge of rack 14 provided on side wall 12*b* of said tank 12 reaches a first microswitch 17 disposed thereabove, said tank 12 then being supported at said position.

Figure 3:
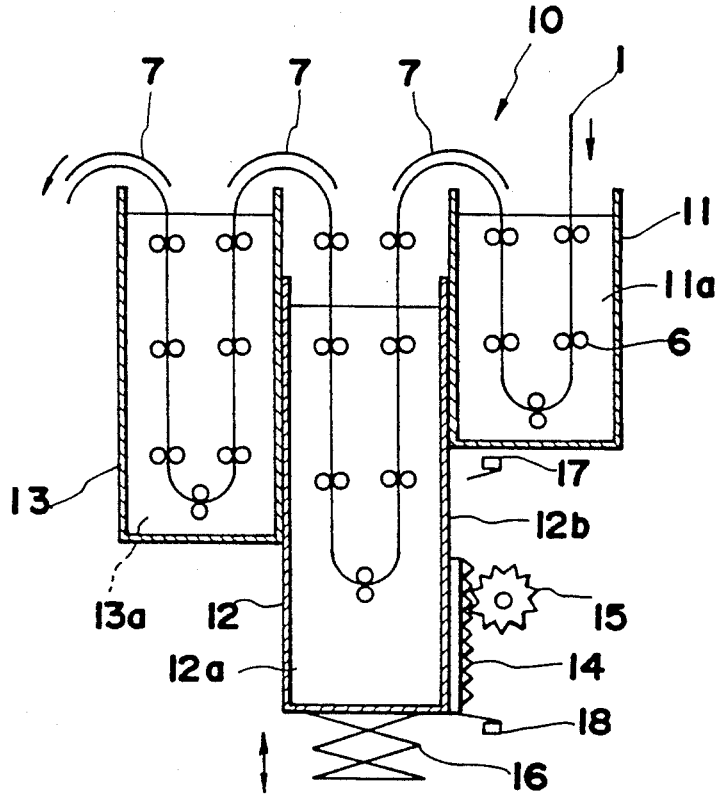

On the other hand, when developing unit 10 is moved to perform routine maintenance or to clear a paper jam or the like, pinion 15 is rotated by means of a motor in the direction which lowers the bleach-fixing tank 12, i.e. in the reverse direction, as shown in FIG. 3, said bleach-fixing tank 12 thereby being lowered until the bottom edge of rack 14 reaches a second microswitch 18 disposed therebelow, and said tank 12 then being supported at said position.

Thus, when only the bleach-fixing tank 12 is moved downward, the fluid level of the bleach-fixing fluid is lower than either the fluid level of the developing fluid 11*a* or the fluid level of the stabilizing fluid 13*a*, even when the bleach-fixing tank 12 is completely filled with bleach-fixing fluid 12*a*, and when the developing unit 10 is moved, said bleach-fixing fluid 12*a* cannot overflow tank 12 to contaminate either the developing tank 11 or stabilizing tank 13.

Figure 5:
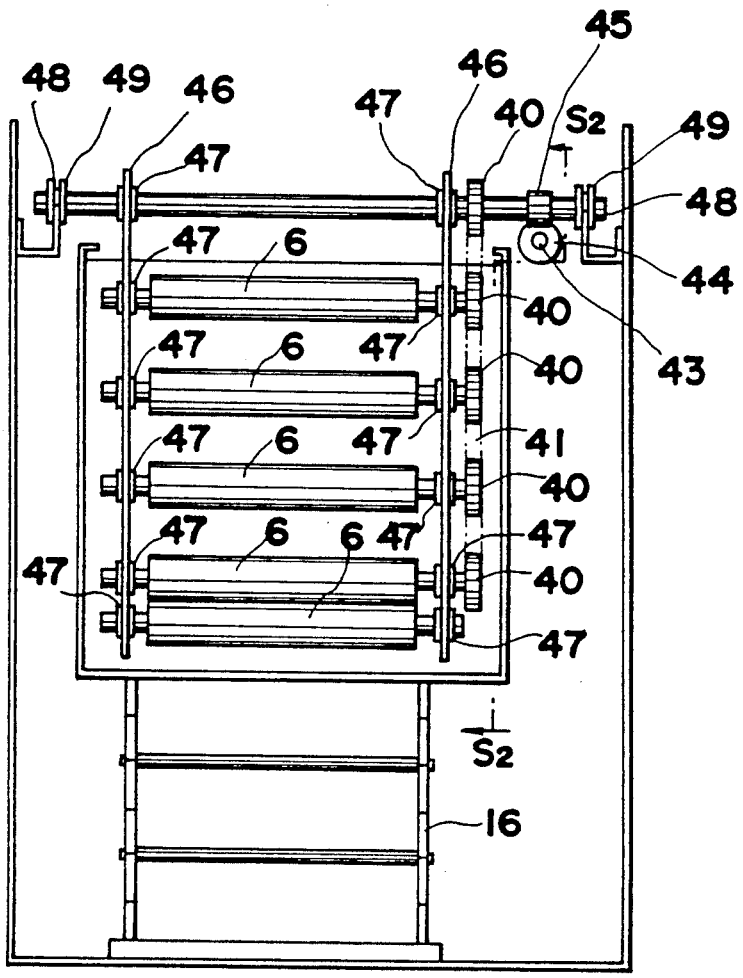
FIG. 5 is a section view along the S1—S1 line shown in FIG. 2.
Figure 6:
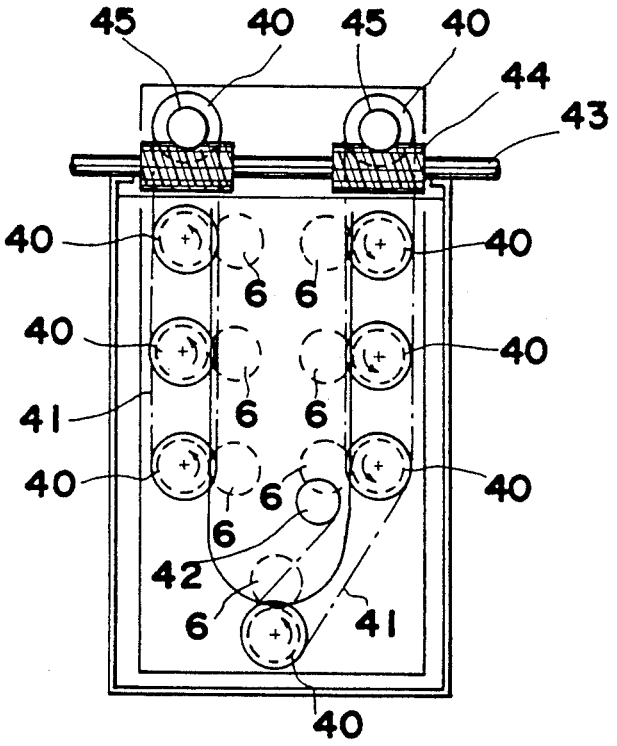
FIG. 6 is a section view along the S2—S2 line shown in FIG. 5.

A description of the construction of the bleach-fixing tank 12 follows hereinafter. FIG. 5 shows the S1—S1 cross section in FIG. 2. FIG. 6 shows the S2—S2 cross section view shown in FIG. 5. As can be understood from these drawings, transport rollers 6 are connected by means of sprockets 40 and chain 41 so as to be mutually rotatable thereby. The transport roller sets comprise a drive roller and a driven roller. Element 42 is a sprocket for maintaining tension on the chain. A driving force from a drive system not shown in the drawings is transmitted to a shaft 43 and thence to a helical gear 45 via worm gear 44 provided above said shaft 43. Thus, sprockets 40 are thereby driven so as to impart a drive force to all transport rollers 6 via chain 41. Each transport roller 6 is respectively mounted to frames 46 by shafts 47. Frames 46, i.e. transport rollers 6, form an integrated unit with member 48 being supported by bearing 49. As can be understood from the drawings, the aforesaid unit is formed so as to be supported by member 48 on top of unit frame 20. Accordingly, this unit does not move even when the bleach-fixing tank 12 is moved in a vertical direction. The aforesaid unit is divided into, at least, developing tank, bleach-fixing tank and stabilizing tank sections, such that when performing roller maintenance the unit is pulled rather than the tanks. Therefore, when maintenance is completed and the unit is replaced in position, the drive force can again be transmitted thereto by connecting bearing 49 with member 48.

Figure 7:
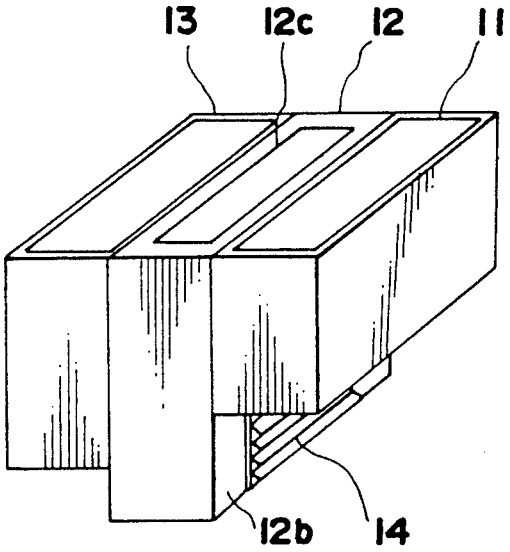
FIGS. 7 and 8 are brief perspective and cross section views, respectively, showing a modified example of the present invention.
Figure 8:
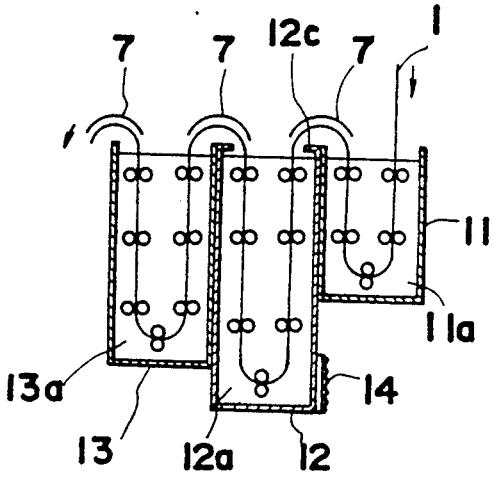

Further, a bent flange 12*c* may be provided at the top edge of bleach-fixing tank 12, as in the modified embodiment shown in FIGS. 7 and 8, thereby even more effectively inhibiting overflow of bleach-fixing fluid 12*a* from tank 12.

The use of a developing apparatus 10 related to the present embodiment of the invention integrated as a unit in a printer and photocopier is hereinafter described.

Machine A, shown in FIGS. 9 through 14, incorporates a developing apparatus 10 which is integrated in a unit, said developing apparatus 10 and a dryer (not shown in the drawings) being accommodated as a single unit within unit frame 20.

Unit frame 20 is provided with a door 21 mounted on its front side, and a track 22 disposed at both sides of said door. Unit frame 20 is thus accommodated so as to be removable by being pulled from the inside of machine A by means of said track 22.

Figure 9:
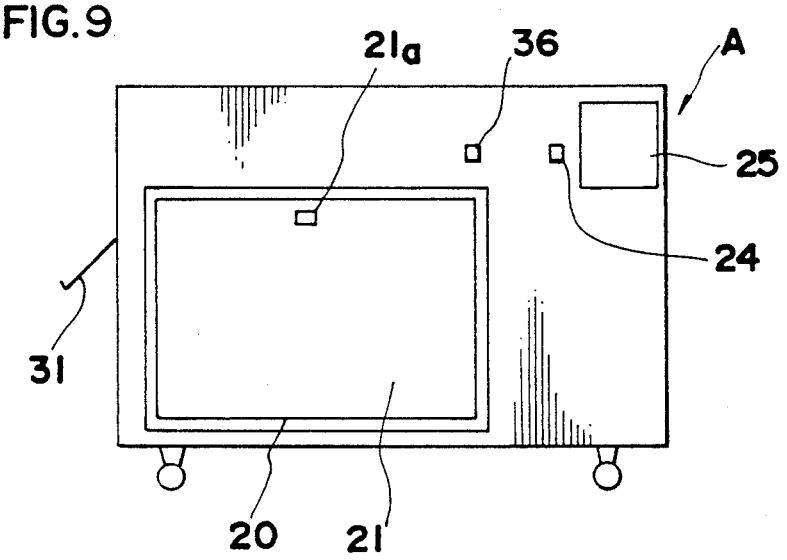
FIGS. 9 through 14 show an example of the embodiments of the present invention used in a developing unit.
Figure 10:
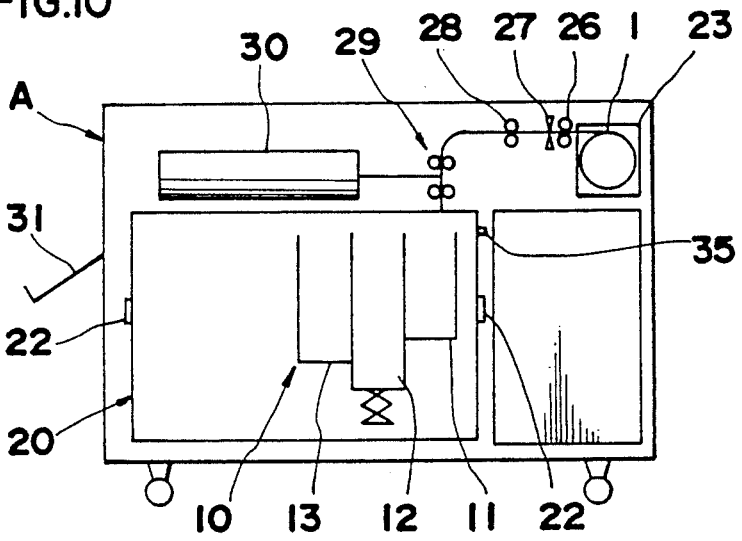
Figure 11:
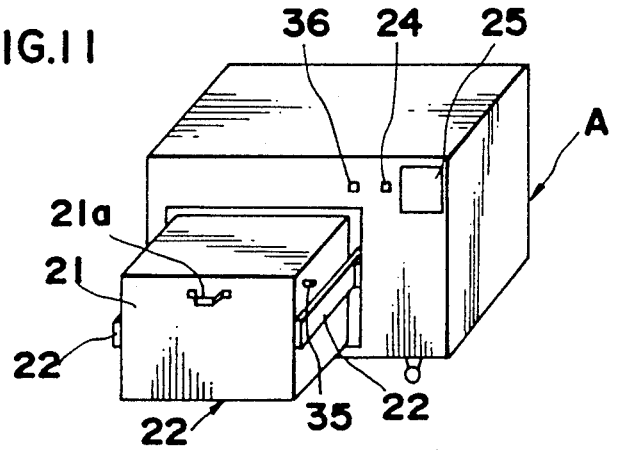

In addition, a magazine 23 accommodating roll type photographic film, photographic paper or other light sensitive material 1 is provided on the top right side of said machine A, as shown in FIGS. 9 through 11, such that when a release button 24, which is disposed on the side wall of said machine A, is pushed, the door 25 opens to release the magazine so a to emplace the magazine 23 for accommodating the roll type light sensitive material 1 within machine A.

In machine A, when the start button (not shown in the drawings) is pushed, the roll type light sensitive material 1 which is accommodated in magazine 23 is pulled from magazine 23 by feed rollers 26 and cut to a length predetermined by a host computer or the like (not shown in the drawings) by means of a cutter 27, and is then transported to a secondary scanning section 29 by transport rollers 28.

Thus, light sensitive material 1 which has been transported to secondary scanning section 29 is subjected to exposure in said secondary scanning section 29 by an optical system 30, thereby a latent image is formed onto the material 1.

When unit frame 20 is accommodated in machine A, the bleach fixing tank 12 is maintained in the raised position, as shown in FIG. 2.

The light sensitive material 1, which has been guided to the developing apparatus 10 as previously described, is transported sequentially to developing tank 11 filled with developing fluid 11*a*, bleach fixing tank 12 filled with bleach fixing fluid 12*a* and stabilizing tank 13 filled with stabilizing fluid 13*a* by means of crossover guides 7, thereafter transported to the drying section and dried, and finally discharged to discharge tray 31.

The removal of the unit frame 20, which accommodates the developing apparatus 10 and drying device, from machine A for the purpose of maintenance and jam correction or the like is described hereinafter.

When unit frame 20 is housed in machine A, a lock lever 33, which is rotatable about a center on shaft 32 attached to the side of said machine A, the force of a spring 34 being applied to said locking lever 33 so as to lock the lever upon a latch pin provided on at least one side of the aforesaid unit frame 20.

A lock release button 36 is provided on the side of machine A and when, in the above described state, said button 36 is pushed, the aforesaid motor provided in the developing apparatus 10 is started, pinion 15 is rotated in the direction to lower the bleach fixing tank 12 so as to lower said tank 12 until the bottom edge of rack 14 reaches the previously described second microswitch 18, whereupon the bleach fixing tank 12 is stopped at the position of said second microswitch 18.

Figure 13:
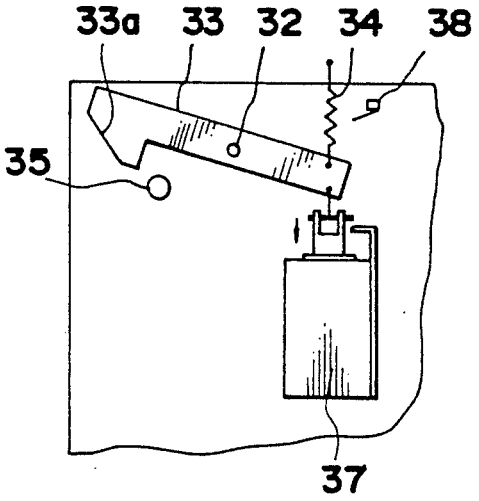
Figure 14:
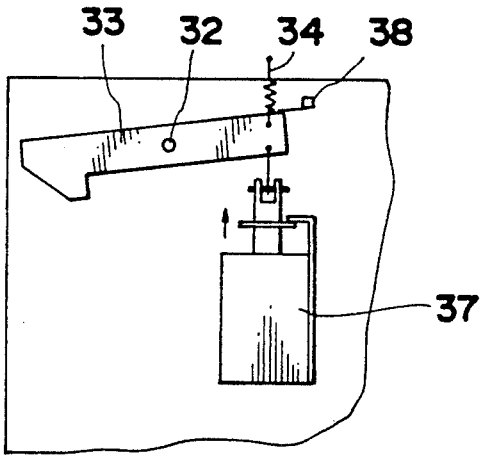

Thus, when the second microswitch 18 is switched ON, solenoid 37 provided in the machine A is actuated and thereby pulls the locking lever 33 against the effect of spring 34 so as to rotate said locking lever 33 and release said lever 33 from latch pin 35, as shown in FIG. 13. Solenoid 37 remains ON for a specific timer period, for example, one minute, so that when the specified timer period has elapsed, said solenoid 37 switches OFF, and the locking lever 33 is rotated due to the force exerted by spring 34, as shown in FIG. 14, and the third microswitch 38 is switched ON.

When the locking lever 33 is in the released state relative to latch pin 35 and the door 21 for unit frame 20 is pulled opened by handle 21*a* provided thereon, the unit frame 20 is pulled from machine A guided by tracks 22.

When said unit frame is pulled from the machine A, the bleach fixing tank 12 is in the lowered position in developing unit 10 housed in unit frame 20, such that the fluid level of bleach fixing fluid 12*a* contained in tank 12 is in a lower position than the top edges of both the developing tank 11 and stabilizing tank 13, and therefore the bleach fixing fluid 12*a* does not overflow from bleach fixing tank 12 into developing tank 11 or stabilizing tank 13 and contaminate the respective fluids contained therein even when the developing unit 10 is shaken as it is moved.

To return the unit frame 20 back into the housed position within machine A after said unit frame 20 has been removed from the machine A and the paper jam cleared or maintenance activity performed, the unit frame 20 is simply pushed back into the machine A.

Figure 12:
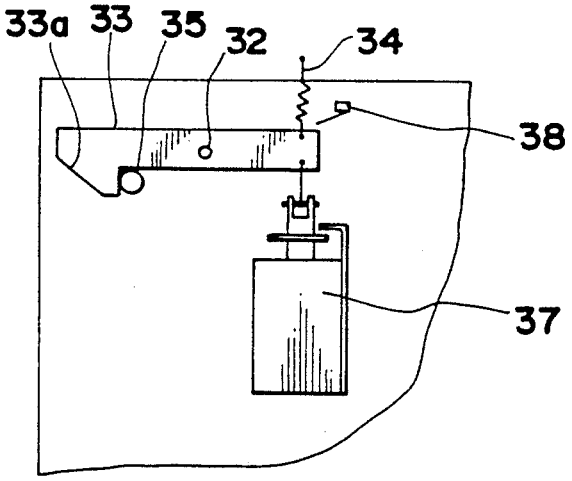

As the unit frame 20 is pushed back into the machine A, the latch pin 35 provided on unit frame 20 is thrust along the slanted portion 33*a* of locking lever 33, and said locking lever 33 subsequently returns to the latched position, as shown in FIG. 12.

When latching pin 35 is in the locked position relative to locking lever 33, the previously described third microswitch 38 is switched OFF, causing the motor for developing unit 10 to actuate so as to rotate pinion 15 in the reverse direction to that for lowering said pinion 15, thereby raising the bleach fixing tank 12.

When the top edge of rack 14 provided on bleach fixing tank 12 reaches said first microswitch 17 position, thus switching said microswitch 17 ON, the motor is stopped, and the bleach fixing tank 12 is maintained in this state, such that the developing tank 11, bleach fixing tank 12 and stabilizing tank 13 are all maintained at an identical height and the developing process may be continued.

Although the present invention has been fully described by way of examples with reference to the accompanying drawings, it is to be understood that various changes and modifications will be apparent to those skilled in the art. Therefore, unless otherwise such changes and modifications depart from the scope of the present invention, they should be construed as being contained therein.

What is claimed is:

1. A developing device for developing an image formed on a light sensitive material, wherein said light sensitive material is sequentially transported through a developing fluid, a bleach fixing fluid and a stabilizing fluid, the device including:

a first tank containing the developing fluid;

a second tank containing the bleach fixing fluid;

a third tank containing the stabilizing fluid; and means for positioning said second tank in a first position and a second position, said second position being located below said first position, said positioning means including means for moving said second tank independently of said first and third tanks.

2. A developing device for developing an image formed on a light sensitive material, wherein said light sensitive material is sequentially transported through a developing fluid, a bleach fixing fluid and a stabilizing fluid, the device comprising:

a first tank containing the developing fluid;

a second tank containing the bleach fixing tank;

a third tank containing the stabilizing fluid, and a moving means for vertically moving the second tank independently of the first and third tanks, said moving means arranged to make a fluid level of the bleach fixing fluid contained in the second tank to be lower than those of the developing and stabilizing fluid contained in the first and third tanks respectively after the second tank is moved.

3. A developing device for developing an image formed on a light sensitive material, wherein said light sensitive material is sequentially transported through a developing fluid, a bleach fixing fluid and a stabilizing fluid, the device comprising:

a first tank containing the developing fluid;

a second tank containing the bleach fixing fluid;

a third tank containing the stabilizing fluid, and a moving means for vertically moving said second tank independently of said first and third tanks to a first level in substantial alignment with said first and third tanks and a second level lower than said first level.

4. A developing device as claimed in claim 3, wherein the second tank is maintained at the first level during the development.

5. A developing device as claimed in claim 3, wherein the second tank is maintained at the second level for maintenance purpose.

6. An image forming apparatus for forming an image on a film of light sensitive material by means of a photographic process wherein the film is sequentially transported through a developing fluid, a bleach fixing fluid and a stabilizing fluid after the film is exposed in an exposing position, the apparatus comprising:

supplying means for supplying the film to the exposing position;

exposing means provided at the exposing position for exposing the supplied film so as to form a latent image onto the film;

a developing means provided at the downstream side of the exposing position relative to the supplying direction of the film for developing the exposed film, said developing means comprising a first tank containing the developing fluid, a second tank containing the bleach fixing fluid and a third tank containing the stabilizing fluid wherein said tanks are disposed adjacent one another;

transporting means for sequentially transporting the exposed film in the order of the first tank, the second tank and the third tank; and moving means for vertically moving the second tank independently of the first and third tanks, said moving means arranged to make a fluid level of the bleach fixing fluid contained in the second tank lower than those of the developing and stabilizing fluid contained in the first and third tanks respectively after the second tank is moved.

7. An image forming apparatus as claimed in claim 6, wherein the developing means is removable from the inside of the apparatus.

8. An image forming apparatus for forming an image on a film of light sensitive material by means of a photographic process wherein the film is sequentially transported through a developing fluid, a bleach fixing fluid and a stabilizing fluid after the film is exposed in an exposing position, the apparatus comprising:

supplying means for supplying the film to the exposing position;

exposing means provided at the exposing position for exposing the supplied film so as to form a latent image onto the film;

a developing means provided at the downstream side of the exposing position relative to the supplying direction of the film for developing the exposed film, said developing means comprising a first tank containing the developing fluid; a second tank containing the bleach fixing fluid and a third tank containing the stabilizing fluid wherein said tanks are disposed adjacent one another;

transporting means for sequentially transporting the exposed film in the order of the first tank, the second tank and the third tank; and moving means for vertically moving said second tank independently of said first and third tanks to a first level in substantial alignment with said first and third tanks and a second level lower than said first level, said second tank being held at said first level during the development and moved to said second level for maintenance purpose.

9. A developing device for developing an image formed on a light sensitive material, wherein said light sensitive material is sequentially transported through a developing fluid, a bleach fixing fluid and a stabilizing fluid, the device including:

a first tank containing the developing fluid;

a second tank containing the bleach fixing fluid;

a third tank containing the stabilizing fluid; and means for vertically positioning said tanks relative to one another in a first position at which the fluid level of the bleach fixing fluid in said second tank is in substantial alignment with the fluid levels of said developing fluid and said stabilizing fluid in said first and third tanks, respectively, and a second position at which the fluid level of the bleach fixing fluid in said second tank is lower than the fluid levels of said developing fluid and said stabilizing fluid in said first and third tanks, respectively.

* * * * *